US012098544B2

(12) United States Patent
Nick et al.

(10) Patent No.: US 12,098,544 B2
(45) Date of Patent: Sep. 24, 2024

(54) DEVICES, SYSTEMS, AND METHODS FOR ASSISTING BUILDING FRAME CONSTRUCTION

(71) Applicants: Henry Nick, Merrillville, IN (US); Guillermo Rivera, Dyer, IN (US)

(72) Inventors: Henry Nick, Merrillville, IN (US); Guillermo Rivera, Dyer, IN (US)

( * ) Notice: Subject to any disclaimer, the term of this patent is extended or adjusted under 35 U.S.C. 154(b) by 0 days.

(21) Appl. No.: 17/501,198

(22) Filed: Oct. 14, 2021

(65) Prior Publication Data

US 2022/0112713 A1 Apr. 14, 2022

Related U.S. Application Data

(60) Provisional application No. 63/091,418, filed on Oct. 14, 2020.

(51) Int. Cl.

| | |
|---|---|
| ***G01B 3/1056*** | (2020.01) |
| ***E04B 2/74*** | (2006.01) |
| ***E04B 2/76*** | (2006.01) |
| ***E04G 21/18*** | (2006.01) |

(52) U.S. Cl.

CPC ..... *E04B 2/7457* (2013.01); *E04B 2/7425* (2013.01); *E04B 2/767* (2013.01); *E04B 2002/7487* (2013.01); *E04B 2002/749* (2013.01)

(58) Field of Classification Search

CPC ..... E04B 2/7457; E04B 2/7425; E04B 2/767; E04B 2002/7487; E04B 2002/749; E04B 5/12

USPC ..... 52/239, 92.1, 92.2, 289

See application file for complete search history.

(56) References Cited

U.S. PATENT DOCUMENTS

| | | | | | |
|---|---|---|---|---|---|
| 1,448,244 | A * | 3/1923 | Wilson | E04B 1/26 | 52/92.1 |
| 1,887,814 | A * | 11/1932 | Le Gall | E04C 2/36 | 52/793.11 |
| 2,187,087 | A * | 1/1940 | Leary | E04G 21/1891 | 33/194 |
| 2,302,194 | A * | 11/1942 | Dayton | E04B 1/2608 | 403/403 |
| 2,589,879 | A * | 3/1952 | Sheppard | E04B 2/707 | 52/762 |
| 3,169,320 | A * | 2/1965 | Currie | E04G 21/1891 | 33/563 |
| 3,807,116 | A * | 4/1974 | Flynn | E04C 2/36 | 428/116 |
| 4,669,235 | A * | 6/1987 | Reinen | E04B 1/2608 | 411/466 |

(Continued)

*Primary Examiner* — James J Buckle, Jr.

(74) *Attorney, Agent, or Firm* — Hartman Global IP Law; Gary M. Hartman; Domenica N.S. Hartman

(57) ABSTRACT

A framing system for constructing a wall frame assembly having a framing member and studs. A template of the framing system has an elongated body configured to be located on a surface of the framing member and a series of spaced apart openings corresponding to locations for placement of ends of the studs. A framing guide of the framing system has a body, a passage that is configured to receive a fastener, and a guiding surface within the passage is disposed at an angle relative to a bottom surface of the body to direct the fastener along a predetermined angle and direction relative to a front surface of the body. The template may be (Continued)

used to locate studs onto the framing member. The framing guide may be used to guide the fastener to connect the stud and framing member.

13 Claims, 7 Drawing Sheets

(56) References Cited

U.S. PATENT DOCUMENTS 4,894,974 A * 1/1990 Mayhew ..... E04C 2/36 52/782.2
4,965,980 A * 10/1990 Leavens ..... E04B 1/2608 52/712
5,012,590 A * 5/1991 Wagner ..... E04G 21/1891 33/759
5,157,892 A * 10/1992 Ryther ..... E04C 2/36 52/793.11
5,335,469 A * 8/1994 Stuart ..... E04B 7/045 52/645
6,360,448 B1 * 3/2002 Smyj ..... E04G 21/1891 33/562
6,895,684 B1 * 5/2005 Firth ..... E04G 21/1891 33/562
7,028,446 B2 * 4/2006 Winchester ..... E04B 7/022 52/746.1
7,059,061 B2 * 6/2006 French ..... E04G 21/1891 33/759
7,114,300 B1 * 10/2006 Culp ..... A47B 47/042 211/186
7,181,887 B1 * 2/2007 Baij ..... E04G 21/1891 52/243
8,061,088 B2 * 11/2011 Walker ..... E04B 7/045 52/696
8,225,521 B1 * 7/2012 Mooney ..... G01B 3/1003 33/759
8,458,980 B2 * 6/2013 Ivanov ..... A63H 33/084 446/105
D686,926 S * 7/2013 Moe ..... D10/64
D713,746 S * 9/2014 Collins ..... D10/64
10,017,951 B2 * 7/2018 Youngborg ..... E04B 2/58
2001/0013178 A1 * 8/2001 Lafrance ..... G01B 3/02 33/645
2002/0095906 A1 * 7/2002 Edmondson ..... E04G 21/1891 52/745.19
2006/0096112 A1 * 5/2006 Berring ..... G01B 3/10 33/759
2008/0010910 A1 * 1/2008 Baij ..... E04B 2/706 52/105
2019/0040639 A1 * 2/2019 Youngborg ..... E04B 2/7457

* cited by examiner

DEVICES, SYSTEMS, AND METHODS FOR ASSISTING BUILDING FRAME CONSTRUCTION

CROSS-REFERENCE TO RELATED APPLICATIONS

This application claims the benefit of U.S. Provisional Application No. 63/091,418 filed Oct. 14, 2020, the contents of which are incorporated herein by reference.

BACKGROUND OF THE INVENTION

The present invention generally relates to building frame construction and methods related thereto. The invention particularly relates to systems, devices, and methods for securing studs to bottom plates and top plates of a wall framing assembly of a building.

Wood frame construction is currently the most common method of building residential homes and apartments in the United States. In wood frame construction, lumber is often spaced and fastened together with fasteners (e.g., nails, screws, etc.) to create floor, wall, and roof assemblies. Wall framing in house construction includes vertical and horizontal framing members of exterior walls and interior partitions, both of load bearing walls and non-load bearing walls. Framing members used in a wall frame assembly are commonly referred to as bottom plates, top plates, and studs, depending on their location within the frame. Bottom plates (also referred to as sill plates and sole plates) serve as horizontal base framing members located at the bottom or base of a wall frame assembly and are typically fastened to the floor on which the wall frame assembly is being installed. Top plates (also referred to as upper wall plates) are horizontal upper framing members located at the top of the wall frame assembly. Studs are vertical framing members typically spaced evenly apart and attached at their upper and lower ends to the top and bottom plates, respectively. Studs provide structural support and serve as a fastening base for covering material. The spacing of the studs in a wall frame assembly may be dependent on various factors such as the specific building plan and local building codes. Typical spacing is twelve, sixteen, or twenty-four inches (about 30, 40, or 61 cm, respectively) on center.

While wood frame construction is quite common, conventional framing assembly can be labor intensive. For example, the studs are preferably equally spaced by a predetermined dimension and oriented perpendicular to the bottom and top plates. This may require builders to manually measure for the location of each stud and level the studs prior to attachment to the frame assembly. However, the process of manually measuring and laying out the location for each stud is both time consuming and subject to the introduction of errors in measurement that cause unwanted variability and/or adversely affect the final wall system. Therefore, it would be desirable if systems and methods were available that were capable of promoting frame assembly construction with reduced labor compared to conventional techniques, such as by reducing the time and/or effort involved in laying out the location of studs along a bottom plate, and/or reducing variability and/or errors in the placement of the studs along the bottom plate.

BRIEF DESCRIPTION OF THE INVENTION

The present invention provides a system with devices and methods that are preferably capable of assisting in frame assembly construction.

According to one aspect of the invention, a template is provided for assisting in building a wall frame assembly that includes a framing member and a plurality of studs coupled to the framing member. The template includes an elongated body configured to be located on a surface of the framing member, and a series of spaced apart openings in the body corresponding to locations for placement of ends of the studs.

Another aspect of the invention is a method of building a wall frame assembly using a template comprising elements as described above. The elongated body of the template is positioned on a surface of the framing member with the series of spaced apart openings disposed at selected positions for the studs. A first end of a first stud is located on the surface of the framing member within a first opening of the series of spaced apart openings. The first end of the stud is secured to the framing member at the location of the first opening.

According to another aspect of the invention, a framing guide is provided for assisting in building a wall frame assembly that includes a framing member and a stud positioned on the framing member. The framing guide includes a body having a top surface, a front surface, and a base that defines a bottom surface. A passage extends between the top surface and the front surface and is configured to receive a fastener. A guiding surface within the passage is disposed at an angle relative to the base and configured to direct the fastener along a predetermined angle and direction relative to the front surface.

Another aspect of the invention is a method of building a wall frame assembly using a framing guide comprising elements as described above. A first end of a stud is located on a surface of the framing member. The framing guide may be positioned against the stud and the framing member such that the base is flush on the surface of the framing member and the front surface is flush against a side surface of the stud. A fastener may be positioned within the passage such that the fastener rests on the guiding surface. The fastener may be driven along the guiding surface, into the side surface of the stud and into the surface of the framing member, thereby securing the stud to the framing member.

Technical effects of templates, framing guides, and methods as described above preferably include the capability of building frame assemblies without manually measuring for the locations of studs and/or without leveling the studs, and yet enabling improvements in the consistency and ease of securing the studs with fasteners. Potential benefits include reduced labor, reduced errors, and/or reduced variability compared to conventional construction techniques.

Other aspects and advantages of this invention will be appreciated from the following detailed description.

DETAILED DESCRIPTION OF THE INVENTION

Figure 1:
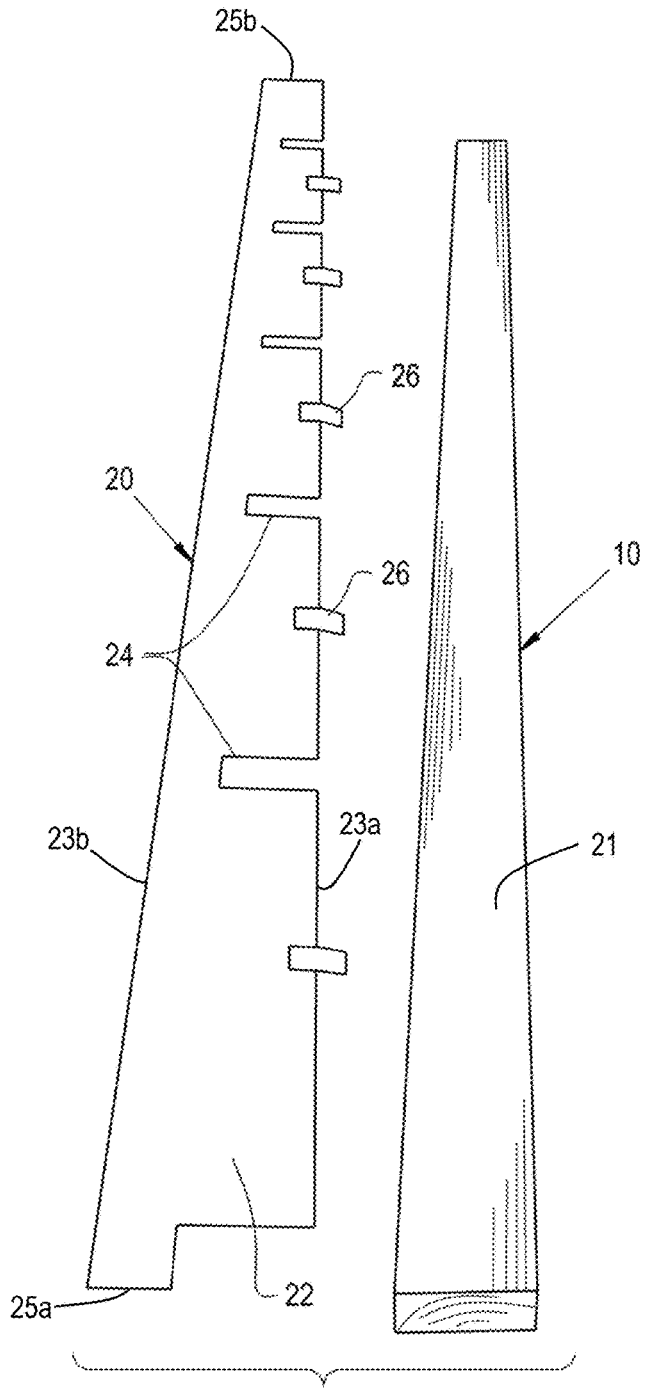
FIG. 1 is a perspective view of a template and a framing member in accordance with certain nonlimiting aspects of the present invention.

The intended purpose of the following detailed description of the invention and the phraseology and terminology employed therein is to describe what is shown in the drawings, which include the depiction of one or more nonlimiting embodiments of the invention, and to describe certain but not all aspects of the embodiment(s) depicted in the drawings. The following detailed description also identifies certain but not all alternatives of the embodiment(s) depicted in the drawings. Therefore, the appended claims, and not the detailed description, are intended to particularly point out subject matter regarded as the invention, including certain but not necessarily all of the aspects and alternatives described in the detailed description.

Disclosed herein are framing systems and methods intended to facilitate building construction, particularly for wood and/or metal frame wall construction. These systems and methods are capable of assisting a builder in constructing a wall frame assembly by efficiently identifying desired locations for the ends of studs on a framing member, assisting in the leveling of studs, and/or promoting ease of fastening the studs to a framing member. By reducing the necessity of conventional measurement and leveling activities, use of the systems, devices, and methods described herein are capable of reducing labor and time requirements for frame construction.

Figure 2:
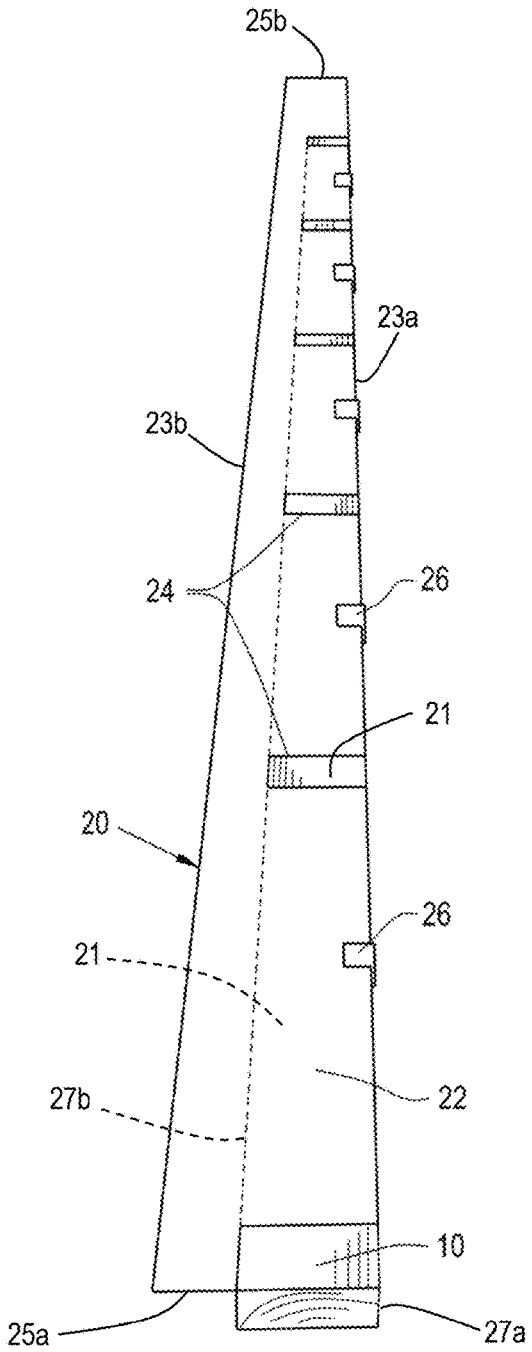
FIG. 2 is a perspective view of the template of FIG. 1 laid out in an operative position on the framing member.
Figure 3:
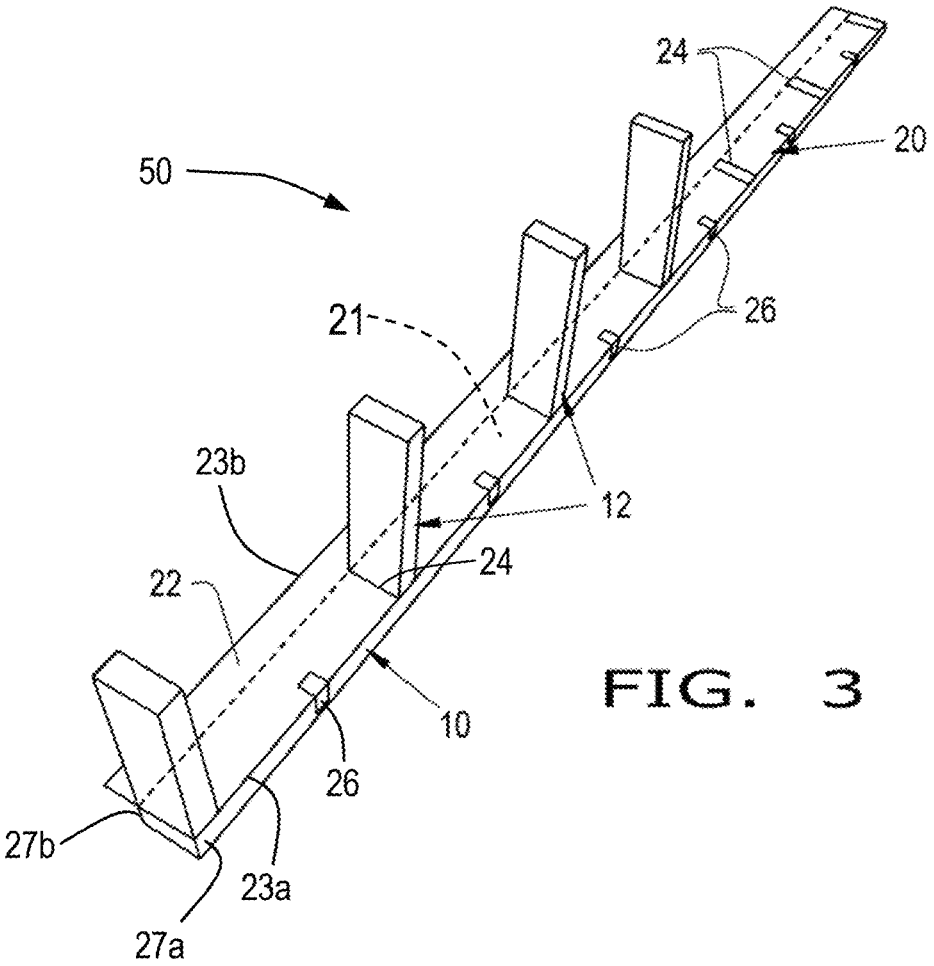
FIG. 3 is a perspective view of a lower part of a wall frame assembly utilizing the template and framing member of FIGS. 1 and 2, in which the framing member is used as a bottom plate and studs are positioned on the bottom plate using the template.

Turning now to the nonlimiting embodiments shown in the drawings, FIGS. 1 through 3 schematically represent various views of a template 20 intended as part of a framing system to assist a builder in determining the spacing and locations of studs 12 on a framing member, represented as a bottom plate 10 of a wall frame assembly 50 in FIG. 3. The template 20 includes a relatively flat, elongated body 22 configured to be located along and at least partially cover an upper (top) surface 21 of the bottom plate 10, as seen in FIGS. 2 and 3, and one or more openings 24 through the elongated body 22 that identify desirable locations for the ends of the studs 12. The elongated body 22 is represented in FIGS. 2 and 3 as sized and shaped to correspond with the size and shape of the upper surface 21 of the bottom plate 10. The body 22 is shown as having opposite first and second side edges 23*a* and 23*b* that extend from a first end 25*a* to a second end 25*b* of the body 22. The body 22 is shown as relatively straight, such that the first and second side edges 23*a* and 23*b* are substantially parallel to each other and to a longitudinal axis of the body 22 that extends between the first and second ends 25*a* and 25*b*, though it is foreseeable that the first and second side edges 23*a* and 23*b* could be other than parallel to each other and/or to the longitudinal axis of the body 22.

The openings 24 are represented as slots that are located on and contiguous with the first side edge 23*a* and spaced apart from each other at preselected distances, such as at regular (i.e., repeating) on-center intervals of twelve inches (about 30.5 cm), sixteen inches (about 40.6 cm), twenty-four inches (about 61 cm), or other predefined intervals as may be desired for various building standards. In other arrangements, the openings 24 may be spaced apart axially at preselected irregular intervals or a mixture of preselected regular and irregular intervals. Each opening 24 extends only part way across the width of the elongated body 22 (i.e., transverse to the longitudinal axis of the body 22) such that at least a portion of the body 22 provides continuity from once side of the opening 24 to the opposite side of the opening 24 in order to hold the body 22 together across the opening 24. Each opening 24 of the template 20 is depicted as extending inwardly from the first side edge 23*a* and part-way across the width of the elongated body 22 such that the openings 24 form gaps along first side edge 23*a*, and the elongated body 22 is continuous along the second side edge 23*b*. In this arrangement, the first side edge 23*a* and the openings 24 can be aligned with and along a corresponding edge of the bottom plate 10 along which the studs 12 are to be aligned. Each opening 24 may be aligned to extend laterally across the width of the elongated body 22 at a pre-defined angle, for example, at an angle that is substantially perpendicular to the longitudinal axis of the body 22 as shown. Furthermore, the openings 24 are represented as sized and shaped to correspond with and receive lower ends of the studs 12 to promote proper and consistent placement of the studs 12 on the bottom plate 10. The openings 24 may be configured to receive various sized studs and may have various spacings depending, for example, on the specific building construction. For example, each opening 24 is represented in the drawings as having a substantially rectangular shape that corresponds with the cross-sectional shape of a standard stud 12, such as a standard 2×4, 2×6, 2×8, 4×4, etc. The openings 24 may have other shapes that are designed to help the user quickly and accurately orient a stud 12 in a desired position on the bottom plate 10.

FIGS. 2 and 3 represent the elongated body 22 as sized and shaped to have a lateral width between the first and second side edges 23*a* and 23*b* that is slightly larger than the width of the bottom plate 10 and the widths of the studs 12. When laid out on the bottom plate 10, the first side edge 23*a* is aligned with a first wall face edge 27*a* of the bottom plate 10, and the second side edge 23*b* extends past an oppositely-disposed second wall face edge 27*b* of the bottom plate 10. In this position, the openings 24 extend from the first wall face edge 27*a* of the bottom plate 10 and across the entire width of the bottom plate 10, and a continuous portion of the elongated body 22 along the second side edge 23*b* extends continuously from the second wall face edge 27*b* of the bottom plate 10 between the first and second ends 25*a* and 25*b* of the elongated body 22. The continuous portion of the template 20 along the first side edge 23*a* hangs over the second wall face edge 27*b* of the bottom plate 10 and keeps the entire template 20 together while allowing the openings 24 to extend across the entire width of the bottom plate 10 so that, as shown, studs 12 may be used that have the same width as the bottom plate 10, and the studs 12 can be set into each opening 24 without trapping any portion of the body 22 of the template 20 between the end of the stud 12 and the upper surface 21 of the bottom plate 10. This may be particularly useful where the studs 12 have the same width as the bottom plate 10, for example when both the studs 12 and the bottom plate 10 are made of standard wood 2×4 s or 2×6 s (or other sizes) or standard metal frame systems. The dimensions of the template 20, and particularly the width dimension, may be selected to correspond to a selected size of the wall frame assembly 50. For example, a template 20 designed for use with 2×4 bottom plate 10 and studs 12 may have a width dimension of about 4 inches (102 mm) to about 6 inches (152 mm), whereas a template 20 designed for use with a 2×6 bottom plate 10 and studs 12 may have a width dimension of about 6 inches (152 mm) to about 8 inches (203 mm). These dimensions are exemplary only of some possible sizes, and are not intended to be limiting, as other dimensions are possible. Also, a template 20 with a particular width is not limited to being used with a bottom plate 10 or studs 12 having only one particular width, but rather the template 20 could also be used with bottom plates and studs that are the width or even wider than the template 20.

The nonlimiting embodiment shown in FIGS. 1 through 3 represent the template 20 as including one or more fasteners 26 that are configured for releasably securing the elongated body 22 to the bottom plate 10 in a selected position. The fasteners 26 may include any means suitable for releasably securing the body 22 to the bottom plate 10. In the depicted example, the fasteners 26 are in the form of strips of adhesive tapes extending outwardly from at least one side edge 23*a* or 23*b* of the elongated body 22 such that each adhesive tape can be folded down onto the bottom plate 10 and adhesively secured thereto. In the nonlimiting embodiment shown in FIGS. 1 through 3, the fasteners 26 are disposed along the first side edge 23*a* and attach to the first wall face edge 27*a* of the bottom plate 10. One or more fasteners 26 may be disposed between each adjacent pair of openings 24, such that the portion of the elongated body 22 between each adjacent pair of openings 24 can be separately (releasably) secured to the underlying bottom plate 10. Additional fasteners 26 may also be disposed at other locations along the elongated body 22, including the ends 25*a* and 25*b* of the body 22. The fasteners 26 may include other types of fastening mechanisms suitable for releasably securing the template 20 to the bottom plate 10.

The template 20 may be formed of various materials to have a suitable thickness for handling. For example, FIGS. 1 through 3 schematically represent the template 20 as being of minimal thickness, such as standard thicknesses for sheets of paper. Additionally, the template 20 may be flexible or rigid. As a nonlimiting example, the template 20 may be formed of a flexible foam material. Other materials, such as paper, cloth, or cardboard may be used. Making the template 20 of a flexible material or a foldable rigid material can be advantageous for storing the template, for example rolled up into a roll or folded in a stack.

During use, a user may locate the template 20 along and on the upper surface 21 of the bottom plate 10 such that all or most of the upper surface 21 is covered, other than the portions exposed through the openings 24 as seen in FIG. 2. For example, FIG. 2 represents the first side edge 23*a* of the template 20 aligned and flush with the wall face edge 27*a* of the bottom plate 10, with the openings 24 also aligned along the wall face edge 27*a*. In this way, the template 20 may also help align the surfaces of the studs 12 with the wall face edge 27*a* of the bottom plate 10, which may help provide a flush front surface of the wall frame assembly 50 against which a wall surface, such as drywall, may lay flush. The elongated body 22 may be trimmed to any desired length, for example, by cutting or tearing, to correspond to the length of a given bottom plate 10. For example, the elongated body 22 may be cut at a selected location, such as immediately adjacent to or at a selected distance from one of the openings 24 so that the first stud 12 is located at a desired distance from the end of the bottom plate 10. If the template 20 is stored in a rolled or folded form, the user may attach one end 25*a* or 25*b* of the elongated body 22 adjacent a first end of the bottom plate 10 and unroll or unfold the elongated body 22 along the length of the bottom plate 10 until the opposite end of the bottom plate 10 is reached. Thereafter, the user may cut the opposite end 25*a* or 25*b* of the elongated body 22 to match the length of the bottom plate 10. Of course, many other methods of locating the template 20 in a desired position along the bottom plate 10 are also possible.

Under many circumstances, it will be desirable to secure the template 20 to the bottom plate 10, such as with one or more of the fasteners 26. For example, FIGS. 2 and 3 evidence that, after laying out the template 20 in a desired position along the bottom plate 10, the fasteners 26 may be folded down onto and affixed to the wall face edge 27*a* of the bottom plate 10 in order to maintain the template 20 in the desired position.

With the template 20 disposed in a desired position, the user may then insert the lower ends of the studs 12 into corresponding openings 24 of the template 20. If the openings 24 are sized and shaped to correspond to the cross-sectional shape of the studs 12, for example, by having a rectangular shape that matches the cross-sectional shape of standard 2×4 lumber, the user may ensure a preferred orientation of the studs 12 relative to the bottom plate 10 by aligning one or more cross-sectional edges of a stud 12 with one or more corresponding edges of the corresponding opening 24. This may further help ensure that the stud 12 is oriented square (or in some other preselected orientation) with the bottom plate 10. Each of the studs 12 may be leveled with a leveling tool, for example to be substantially vertical, and secured to the bottom plate 10 with fasteners. Once the studs 12 are secured to the bottom plate 10, the template 20 may be removed from the upper surface 21 of the bottom plate 10, for example by detaching the releasable fasteners 26 and pulling the template 20 away from the studs 12.

Although the template 20 has been described and depicted herein in reference to assembling studs to bottom plates of a wall frame assembly 50, the template 20 may be used to assist in securing studs to top plates or other framing members in a similar manner to that described above. In addition, the template 20 may be modified for use in assembling other portions of a frame construction, such as but not limited to securing roof rafters to ridge beams, collar beams, fascia boards, struts, or top plates, or providing spacing for windows or doors in wall frame assemblies.

Figure 4:
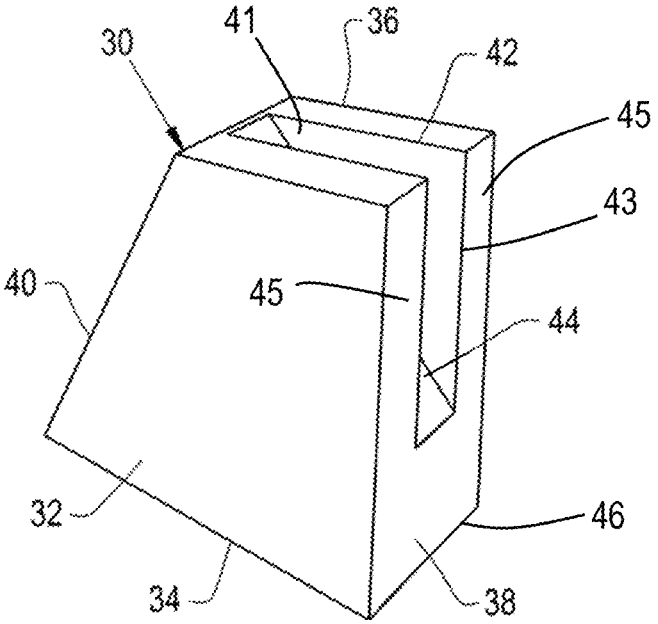
FIG. 4 is a side perspective view of a framing guide in accordance with certain nonlimiting aspects of the present invention.
Figure 5:
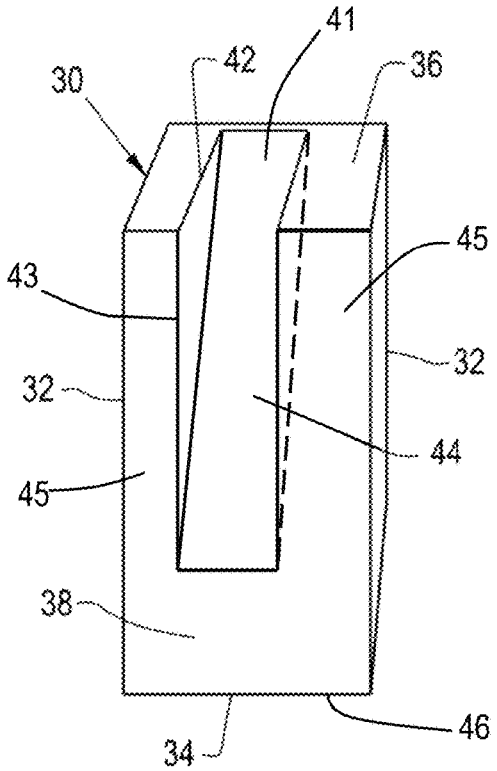
FIG. 5 is a front perspective view of the framing guide of FIG. 4.
Figure 6:
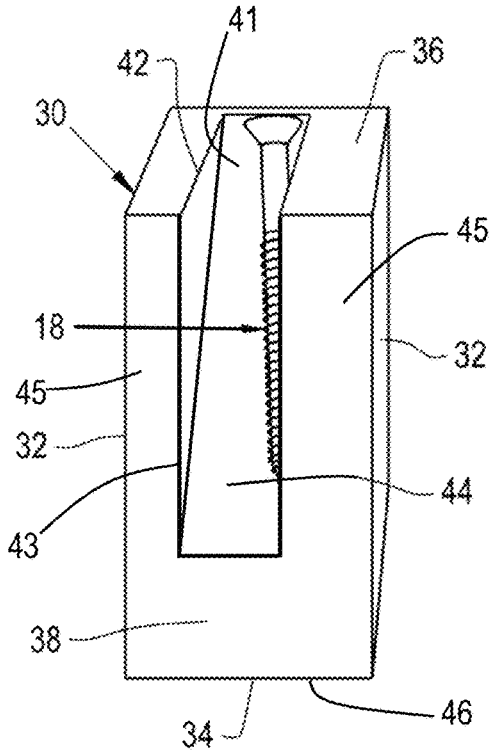
FIG. 6 is a front perspective view of the framing guide of FIG. 4 with a screw disposed therein.
Figure 7:
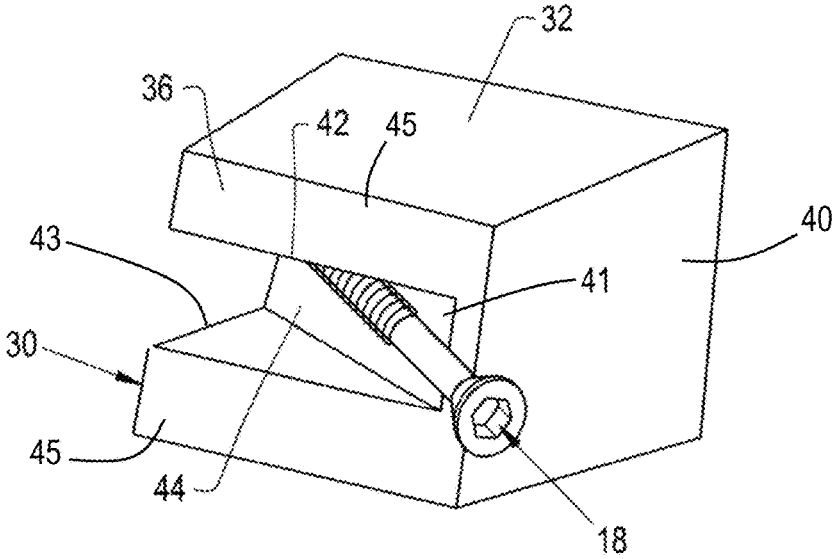
FIG. 7 is a top perspective view of the framing guide and screw of FIG. 6.

FIGS. 4 through 7 show various views of a framing guide 30 configured as part of a framing system to facilitate fastening the studs 12 to a framing member, such as the bottom plate 10 of FIG. 3. The framing guide 30 has a body that includes lateral side surfaces 32, a base 34, a top surface 36, a front surface 38, and a rear surface 40. The side surfaces 32, top surface 36, front surface 38, and rear surface 40 are represented in FIGS. 4 through 7 as planar. The base 34 defines a bottom surface that may also be planar or at least is capable of cooperating with the front surface 38 so that the base 34 (its bottom surface or contact points thereof) is able to engage the upper surface 21 of a bottom plate 10 while the front surface 38 (or contact points thereof) simultaneously engages a stud 12 oriented perpendicular to the upper surface 21 of the bottom plate 10. With the front surface 38 and base 34 oriented perpendicular to each other to form a right angle therebetween, the framing guide 30 is capable of being used to align a stud 12 at a right angle relative to a bottom plate 10. Depending on the intended wall frame assembly 50 being constructed, other angles between the front surface 38 and the bottom surface of the base 34 are also possible. Optionally, the base 34 is represented in FIGS. 4 and 7 as longer or otherwise larger than the top surface 36 to stabilize the framing guide 30 during use. In the nonlimiting embodiment represented in the drawings, the rear surface 40 slopes relative to the front surface 38 to accommodate the larger base 32 and the perpendicular orientation between the base 34 and the front surface 38, and may serve to facilitate grasping of the framing guide 30 by a user. The framing guide 30 is preferably sized so as to be easily grasped and manipulated with one hand of a user. In one nonlimiting embodiment, the framing guide 30 may have dimensions of from about 1 inch (about 2.5 cm) to about 9 inches (about 23 cm) between the front and rear surfaces 38 and 40, and from about 0.5 inches (about 13 mm) to about 4 inches (about 10 cm) between the side surfaces 32. Other sizes and dimensions are also contemplated.

FIGS. 4 through 7 represent the framing guide 30 as having a passage 41 that extends therethrough between the top surface 36 and the front surface 38, such that that passage 41 defines openings 42 and 43 in, respectively, the top and front surfaces 36 and 38. The passage 41 is sized and configured to receive a fastener 18 (FIGS. 6 and 7), such as a nail or screw, and forms a guiding surface 44 that supports and guides the fastener 18 in a manner that enables the framing guide 30 to facilitate driving the fastener 18 into the stud 12 and secure the stud 12 to the bottom plate 10. FIGS. 4 through 7 represent the guiding surface 44 as planar and extending at a constant angle relative to the top and front surfaces 36 and 38. Nonlimiting examples of suitable angles for the guiding surface 44 are about 10° to about 80° from the bottom surface of the base 34. The guiding surface 44 is adapted to slidingly receive the fastener 18 through the opening 42 at the top surface 36 and guide the fastener 18 at a downward angle toward the opening 43 at the front surface 38, where the fastener 18 exits the passage 41, engages the stud 12, and can be driven into the stud 12 and bottom plate 10, respectively, to join the stud 12 to the bottom plate 10.

The passage 41 is represented in the drawings as a recess or slot as a result of the openings 42 and 43 in the top and front surfaces 36 and 38 being contiguous, though it is foreseeable that the passage 41 could be formed as an enclosed through-hole that extends between the top and front surfaces 36 and 38. Furthermore, the guiding surface 44 could be other than planar, for example, shaped as a groove having a U-shaped cross-section, or have a U-shaped recess that extends the entire length of the guiding surface 44. Furthermore, while a constant angle is believed to be preferred, it is foreseeable that the guiding surface 41 could be arcuate or disposed at multiple different angles as it passes through the framing guide 30 from the top surface 36 to the front surface 38. In the embodiment represented in FIGS. 4 through 7, the passage 41 is separated from the side surfaces 32 by walls 45 that restrict lateral movement of the fastener 18 within the passage 41.

The opening 43 of the passage 41 at the front surface 38 is represented as terminating above the intersection 46 between the front surface 38 and the bottom surface of the base 34, and in combination with the angle of the guiding surface 44 through the framing guide 30 determines the placement of the fastener 18 through the joint formed by the stud 12 and the bottom plate 10. For example, the lowermost extent of the opening 43 at the front surface 38 may be a predetermined distance of about 0.25 inches (about 6 mm) to about 3 inches (about 8 cm), more preferably about 0.5 inches (about 13 mm) to about 1.5 inches (about 4 cm) above the intersection 46 and, therefore, above the bottom surface of the base 34 to facilitate driving the fastener 18 into the stud 12 at a suitable distance above the bottom plate 10 and the abutting end of the stud 12.

The framing guide 30 may be formed of various materials such as but not limited to polymers, wood, metallic materials, and composites. Preferably, the framing guide 30 is formed of a rigid material to promote proper placement of a fastener with the guiding surface 44 and proper leveling of studs, if configured for such function. The guiding surface 44 may be covered with a metallic or other wear-resistant insert to reduce the likelihood of damage thereof by fasteners during use of the framing guide 30. According to one nonlimiting embodiment, the framing guide 30 is formed of a rigid polymeric material and the guiding surface 44 is defined by an insert formed of a metallic material.

Figure 8:
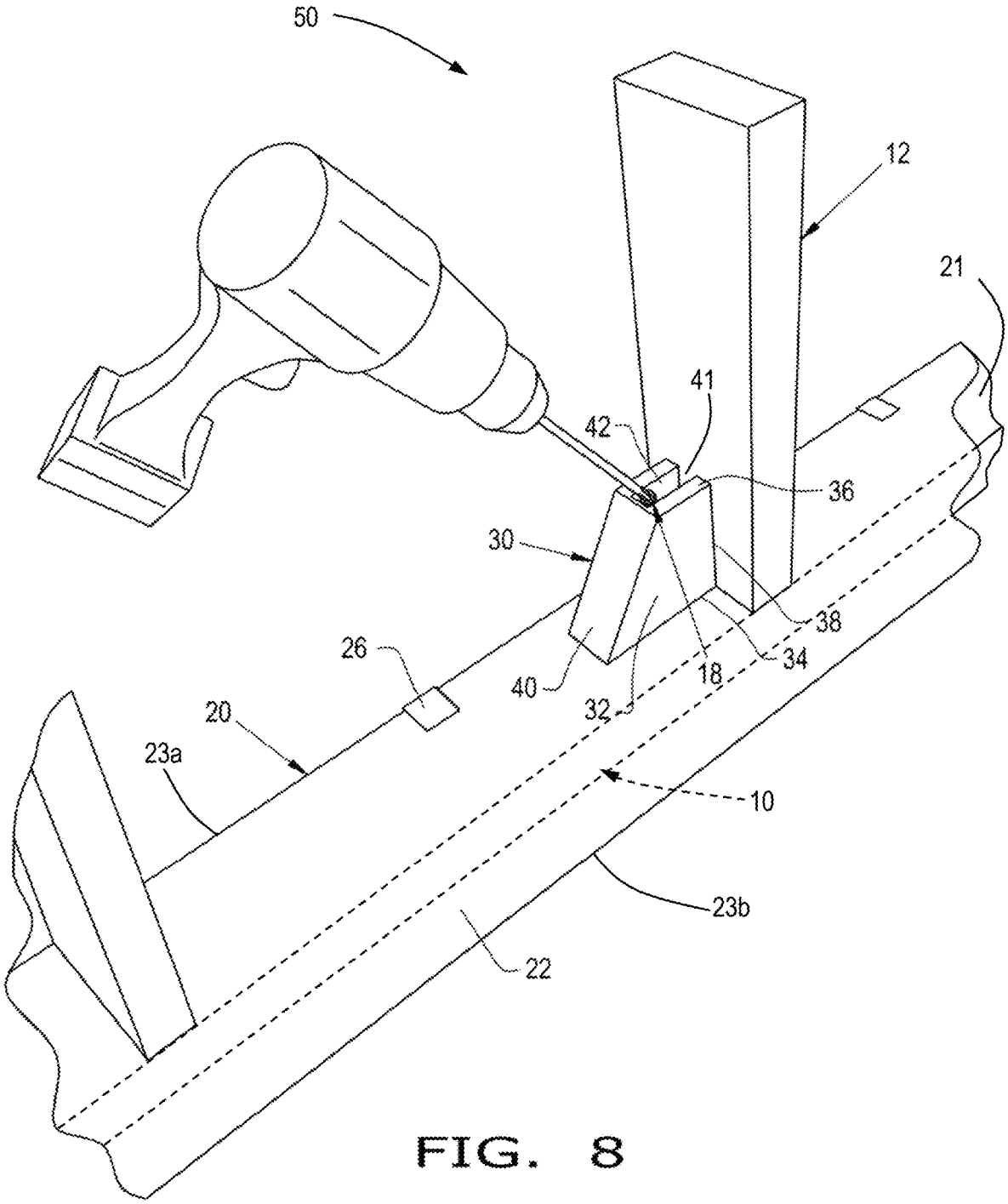
FIG. 8 is a perspective view of the framing guide of FIGS. 4 through 7 being used in combination with the template of FIGS. 1 through 3 to guide the screw into one of the studs of FIG. 3 and subsequently into the bottom plate of a wall frame assembly.

FIG. 8 illustrates a step of a method of using the framing guide 30 to attach a stud 12 to a bottom plate 10 in the construction of a wall frame assembly 50. Although not required, the template 20 of FIGS. 1 through 3 is also shown as used to position the stud 12 on the bottom plate 10. After the stud 12 has been located with the template 20 at a desired position on the bottom plate 10, such as was described previously in reference to FIGS. 1 through 3, the framing guide 30 may be used to orient the stud 12 relative to the bottom plate 10 and to guide a fastener 18, such as a framing nail or screw, at a predefined angle and position into the stud 12 and then into the bottom plate 10 to secure the stud 12 to the bottom plate 10 and create a secure joint therebetween. In such a method, the bottom surface of the base 34 is located flush on the bottom plate 10 (or the template 20 if present) and the front surface 38 is placed flush against a side of the stud 12 to ensure that the stud 18 is oriented at the predefined angle between the front surface 38 and the base 34, such as perpendicular (i.e., a 90° angle). A fastener 18, such as a wood screw or a framing nail, is placed within the passage 41 against the guiding surface 44 such that the fastener 18 is oriented along the predefined angle of the guiding surface 44. While held in this position, the fastener 18 can be driven along the guiding surface 44 into the stud 12 at the predefined angle and direction determined by the guiding surface 44. Advantageously, the fastener 18 will enter the stud 18 at a predefined height above the stud 12 as generally determined by the distance between the lowermost extent of the opening 43 at the front surface 38 and the intersection 46 between the front surface 38 and the bottom surface of the base 34, and the fastener 18 will enter the stud 18 at the predefined angle as defined by the framing guide 30. The result is that more consistent joints, more optimal constructions, and reduced incidents of misalignment and/or non-optimal joint arrangements may be achieved. Once the fastener 18 is driven into the stud 12, either entirely or to an extent sufficient to secure the stud 12 to the bottom plate 10, the framing guide 30 may be removed.

Figure 9:
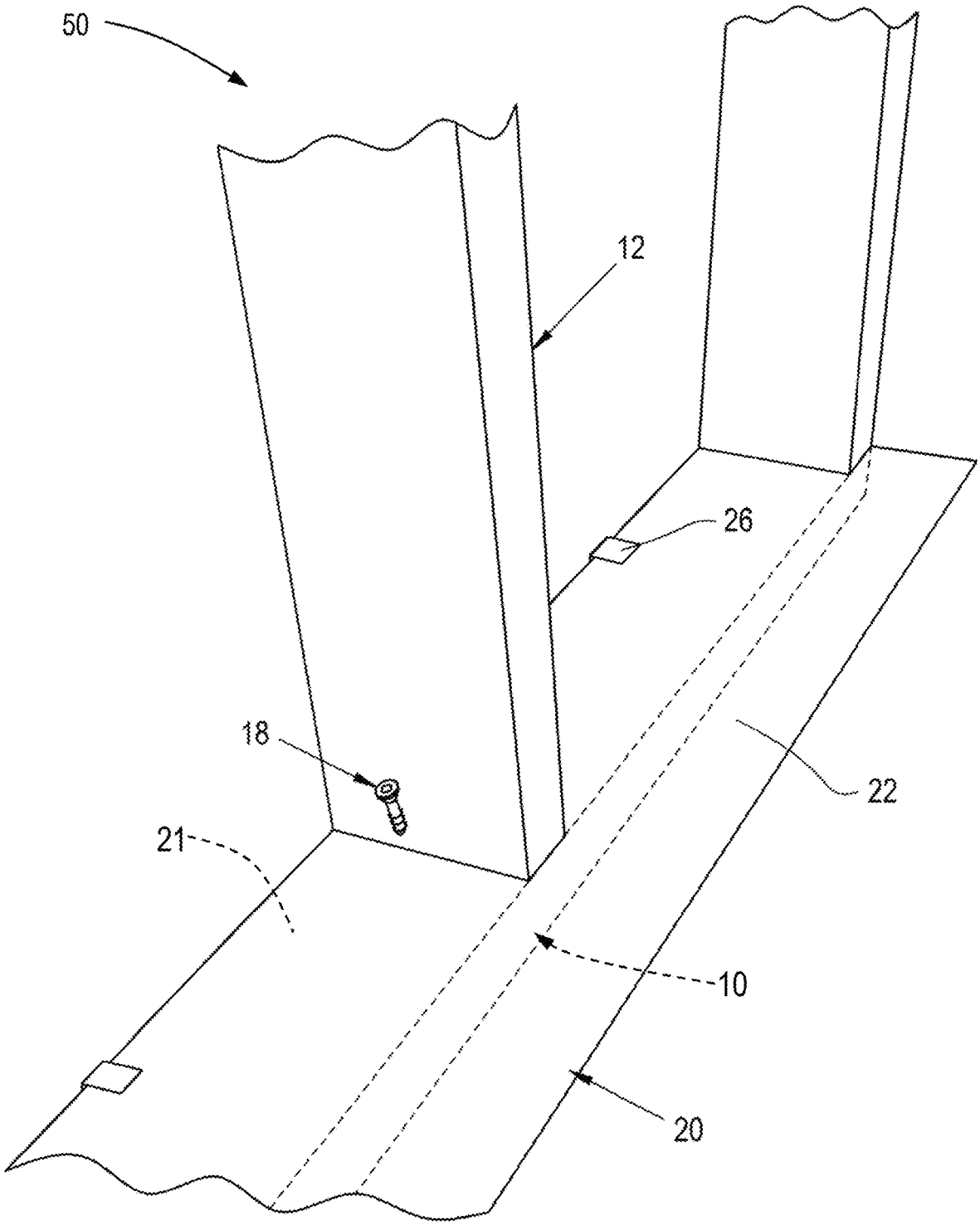
FIG. 9 is a perspective view of the partial frame assembly of FIG. 8 representing the stud secured to the bottom plate with the screw.

FIG. 9 shows the stud 12 secured to the bottom plate 10 with the partially inserted fastener 18 after the framing guide 30 has been removed. Notably, if the base 34 and the front surface 38 are both planar and perpendicular to one another, it may be possible to level the stud 12 solely with the framing guide 30 using the method described. Alternatively, the stud 12 may be leveled with a leveling device, such as a plumb-line or a laser device, prior to or simultaneously while using the framing guide 30. From the foregoing, it should be appreciated that the framing guide 30 can be used to similarly secure the upper end of a stud 12 to a top plate of the wall frame assembly 50.

Figure 10:
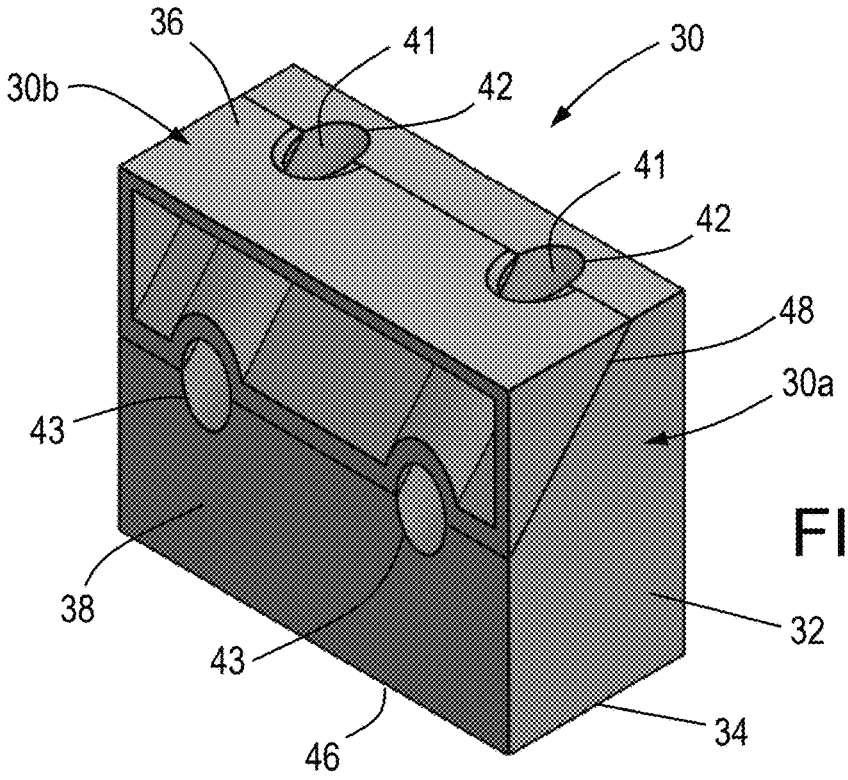
FIG. 10 is a perspective view of an alternative framing guide in accordance with a nonlimiting aspect of the present invention.

FIG. 10 is a perspective view of an alternative framing guide 30 in accordance with another nonlimiting embodiment of the invention. In view of similarities between the embodiments of the framing guide 30, the following discussion of the embodiment depicted in FIG. 10 will focus primarily on aspects thereof that differ from the embodiment seen in FIGS. 4 through 8 in some notable or significant manner. Other aspects of the embodiment of FIG. 10 not discussed in any detail can be, in terms of structure, function, materials, etc., essentially as was described for the embodiment depicted in FIGS. 4 through 8.

Figure 12:
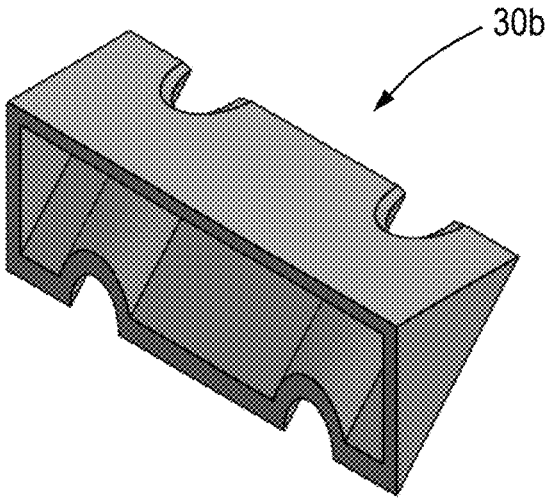
FIGS. 11 and 12 are perspective views of, respectively, lower and upper members of the alternative framing guide of FIG. 10.
Figure 11:
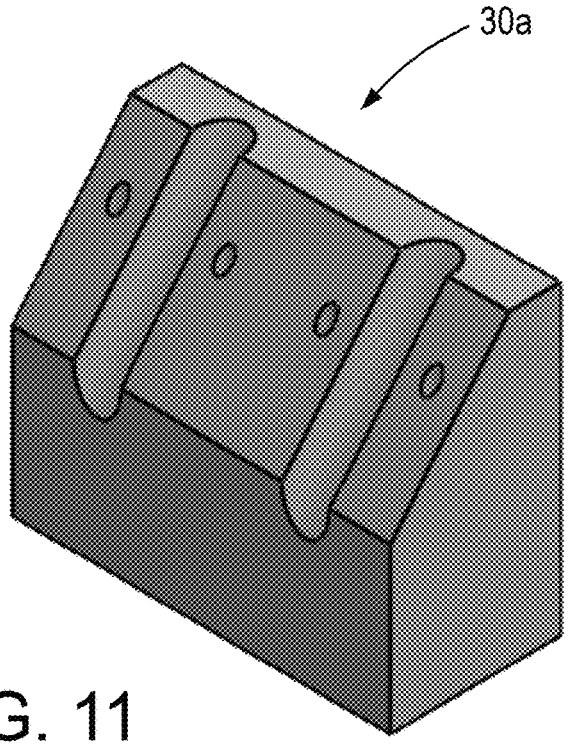

The framing guide 30 depicted in FIG. 10 comprises two framing guide members 30*a* and 30*b* that are individually depicted in FIGS. 11 and 12 and, when assembled as shown in FIG. 10, define two passages 41 that are entirely enclosed except for their openings 42 and 43 at the top and front surfaces 36 and 38, respectively. In this configuration, each passage 41 of the framing guide 30 of FIG. 10 is a through-hole that extends between the top and front surfaces 36 and 38 of the framing guide 30. Each framing guide member 30*a* and 30*b* defines a fraction of each passage 41, represented in FIGS. 10 through 12 as roughly one-half of each passage 41. The members 30*a* and 30*b* have complementary mating surfaces that, when the members 30*a* and 30*b* are assembled as the framing guide 30, define a mating interface 48. The member 30*a* defines the entirety of the rear surface 40, the entirety of the bottom surface of the base 34, and the surface region of the front surface 38 between the lowermost extents of the openings 43 at the front surface 38 and the intersection 46 between the front surface 38 and the bottom surface of the base 34. In combination the members 30*a* and 30*b* define the side surfaces 32 and the top surface 36.

Figure 13:
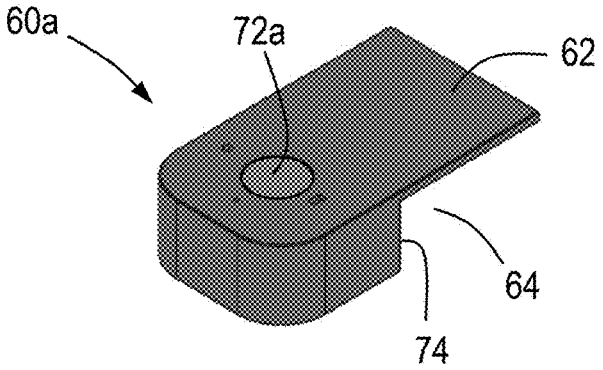
FIGS. 13 and 14 are perspective views of leveling units in accordance with nonlimiting aspects of the present invention, and FIG. 15 schematically represents the use of the leveling units to align a top plate with a bottom plate of a wall frame assembly.
Figure 14:
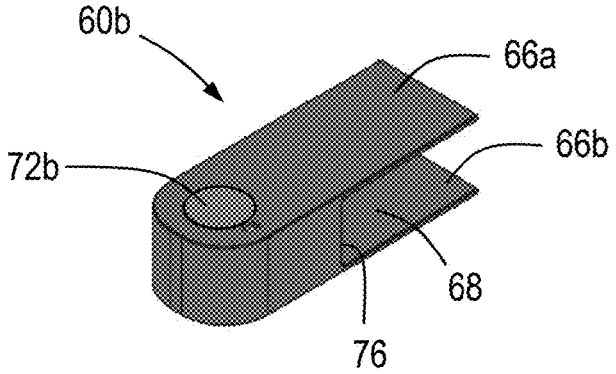
Figure 15:
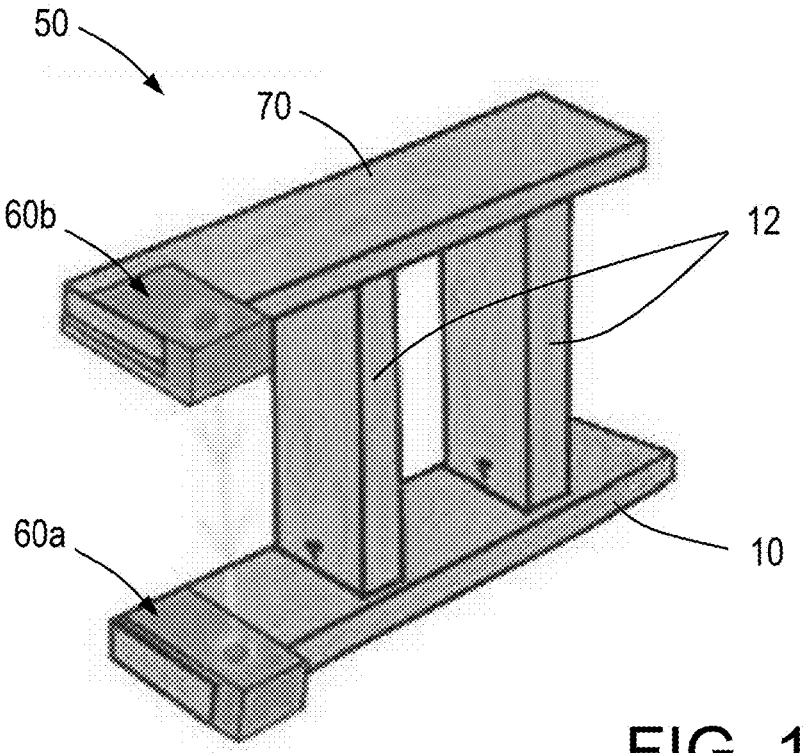

FIGS. 13 and 14 are perspective views of two leveling units 60*a* and 60*b* of a leveling system that can be part of a framing system and used independently of or in combination with either of the template 20 and framing guide 30 depicted in FIGS. 1 through 12. As schematically represented in FIG. 15, the leveling system is adapted to ensure that a wall frame assembly 50 is true, plumb, and level from a top plate 70 through a set of studs 12 to a bottom plate 10 of the wall frame assembly 50. Each unit 60*a* and 60*b* of the leveling system includes a light-emitting unit 72*a* or 72*b*, such as a laser or light-emitting diode (LED)), which respond in pair to ensure that the wall frame assembly 50 is assembled correctly. For this purpose, one of the leveling units 60*a* or 60*b* may be configured as a light generator and the other a light receiver for receiving light generated by the other unit 60*a* or 60*b*.

As represented in FIG. 15, the leveling unit 60*a* is configured to be installed on the bottom plate 10, and the leveling unit 60*b* is configured to be installed on the top plate 70. For this purpose, the leveling unit 60*a* has a single upper flange 62 so that a cavity 64 is defined beneath the flange 62 that is sized and shaped to be complementary to and receive the cross-section of the bottom plate 10, and the leveling unit 60*b* has a pair of spaced-apart flanges 66*a* and 66*b* that define therebetween a cavity 68 that is sized and shaped to be complementary to and receive the cross-section of the top plate 70. The light-emitting unit 72 and 72*b* of each leveling unit 60*a* and 60*b* is disposed the same distance from a gauging wall 74 or 76 defined by and within its corresponding cavity 64 or 68. When the units 60*a* and 60*b* are installed on the bottom and top plates 10 and 70 and in-line with each other as represented in FIG. 15, the light-emitting units 72*a* and 72*b* may indicate by a visual or audible signal that the wall frame assembly 50 is level, straight, and/or plumb. If the light-emitting units 72*a* and 72*b* indicate that the wall frame assembly 50 is not level, straight and/or plumb, the user can make adjustments to the studs 12 and/or top plate 70 to result in a level, straight, and/or plumb indication from the light-emitting units 72*a* and 72*b*, after which the leveling units 60*a* and 60*b* can be removed and relocated to a different section of the wall frame assembly 50 or a different wall frame assembly.

While framing systems and components thereof have been described in terms of specific or particular embodiments, it should be apparent that alternatives could be adopted by one skilled in the art. For example, the particular embodiments were directed to use with wood frame construction, however, the teachings of this invention could be utilized to assist with metal frame construction. In addition, appropriate modifications to the template 20, framing guide 30, and leveling system and their respective components could differ in appearance and construction from the embodiments described herein and shown in the drawings, yet perform similarly. Functions of certain components of the template 20, framing guide 30, and leveling system could be performed by components of different construction but capable of a similar (though not necessarily equivalent) function, and various materials could be used in the fabrication of the template 20, framing guide 30, leveling system, and/or their respective components. Other accessories, such as alternative or additional leveling tools, could be designed to function in combination with the nonlimiting embodiments described herein. Further, any one or more of the various components and/or features of the framing systems may be used alone or in combination with any one or more of the other components and/or features disclosed herein. The phraseology and terminology employed above are for the purpose of describing the disclosed nonlimiting embodiments, and do not necessarily serve as limitations to the scope of the invention. Accordingly, the invention is not necessarily limited to any specific embodiments described herein or illustrated in the drawings.

The invention claimed is:

1. A template for assisting in building a wall frame assembly that includes a framing member and a plurality of studs coupled to the framing member, the template comprising:

an elongated body configured to be located on a surface of the framing member; and a series of spaced apart openings in the elongated body corresponding to locations for placement of ends of the plurality of studs;

wherein the openings are spaced apart longitudinally along an axis of the elongated body at regular intervals, each opening is a slot, the slots are located on and contiguous with a first side edge of the elongated body, and the slots extend from the first side edge laterally part-way across a width of the elongated body;

wherein adhesive tape fasteners are disposed along the first side edge of the elongated body between adjacent openings and configured to releasably secure the elongated body to the framing member, and wherein the openings are complementarily sized and shaped to receive the ends of the plurality of studs.

2. The template of claim 1, wherein each opening has a generally rectangular shape corresponding to a cross-sectional shape of the plurality of studs.

3. The template of claim 1, wherein a continuous portion of the elongated body defines a second side edge of the elongated body that is opposite the first side edge, and the openings are disposed between the continuous portion and the second side edge.

4. The template of claim 1, wherein the elongated body is formed of a flexible material.

5. A method of building a wall frame assembly, the method comprising:

positioning an elongated body with a series of longitudinally spaced apart openings disposed at preselected positions on a surface of a framing member, wherein each opening is a slot, the slots are located on and contiguous with a first side edge of the elongated body, and the slots extend from the first side edge laterally part way across a width of the elongated body;

releasably securing the elongated body to the framing member with adhesive tape fasteners disposed along the first side edge of the elongated body between adjacent openings;

locating a first end of a first stud on the surface of the framing member within a first opening of the series of longitudinally spaced apart openings; and securing the first end of the first stud to the framing member at a location of the first opening.

6. The method of claim 5, further comprising aligning edges of the first end of the first stud with edges of the first opening prior to securing the first end of the first stud to the framing member.

7. The method of claim 5, further comprising:

providing a framing guide comprising:

a body having a top surface, a front surface, and a base that defines a bottom surface;

a passage extending between the top surface and the front surface and defining openings in the top surface and the front surface, the passage being sized and configured to receive a fastener; and a guiding surface within the passage, disposed at an angle relative to the front surface, and configured to direct the fastener along a predetermined angle and direction from the top surface toward the front surface; and wherein the securing step comprises:

positioning the framing guide against the first stud and the framing member such that the base is flush on the surface of the framing member and the front surface is flush against a side surface of the first stud;

positioning a fastener within the opening such that the fastener rests on the guiding surface;

driving the fastener along the guiding surface, into the side surface of the first stud and into the surface of the framing member, thereby securing the first stud to the framing member; and removing the framing guide from the framing member.

8. The method of claim 7, wherein the providing step comprises providing the openings in the top surface and the front surface to be contiguous with each other, and the passage to be a recess in the body of the framing guide between two side walls of the body.

9. The method of claim 7, wherein the providing step comprises providing the passage as a through-hole in the body of the framing guide.

10. The method of claim 9, wherein the providing step comprises providing the body as an assembly of at least first and second members, and each of the first and second members forms a part of the passage.

11. The method of claim 7, wherein the providing step comprises providing the opening in the front surface to have a lowermost extent that is a predetermined distance from the bottom surface of the body.

12. The method of claim 7, wherein the providing step comprises providing the front and bottom surfaces to be perpendicular to each other.

13. The method of claim 7, wherein the base and the front surface are perpendicular to one another, and the surface of the stud is oriented perpendicular to the surface of the framing member when the front surface and the bottom surface of the framing guide are simultaneously positioned against the stud and the framing member, respectively.

* * * * *